US006807774B1

(12) United States Patent
Nottingham et al.

(10) Patent No.: US 6,807,774 B1
(45) Date of Patent: Oct. 26, 2004

(54) GREASELESS FULCRUM FOR A RAILCAR DOOR

(75) Inventors: Scot J. Nottingham, Greenville, PA (US); Robert Jackson, Coloma, MI (US)

(73) Assignee: YSD Industries Inc., Youngstown, OH (US)

( * ) Notice: Subject to any disclaimer, the term of this patent is extended or adjusted under 35 U.S.C. 154(b) by 0 days.

(21) Appl. No.: 10/074,994

(22) Filed: Feb. 13, 2002

(51) Int. Cl.[7] ..... E05D 15/10

(52) U.S. Cl. ..... 49/216; 292/DIG. 57; 292/DIG. 32

(58) Field of Search ..... 49/209, 211, 216, 49/218, 219, 220; 292/DIG. 57, DIG. 58, DIG. 32

(56) References Cited

U.S. PATENT DOCUMENTS 3,800,472 A * 4/1974 Nagy ..... 49/426
4,064,810 A 12/1977 Jenkins et al.
4,319,429 A 3/1982 Seitz
5,016,393 A * 5/1991 Weinerman ..... 49/395
5,046,770 A * 9/1991 Hansen ..... 292/218
5,718,466 A * 2/1998 Weinerman et al. ..... 292/218
5,718,467 A * 2/1998 Weinerman et al. ..... 292/218
6,132,095 A * 10/2000 Crystal ..... 384/125

* cited by examiner

*Primary Examiner*—Jerry Redman
(74) *Attorney, Agent, or Firm*—Fay, Sharpe, Fagan, Minnich & McKee, LLP

(57) ABSTRACT

A plug-type railcar door (10) includes a substantially planar wall of sheeting (14) reinforced with horizontal channels (16). The door includes plural elongated support members (18) rotatably mounted thereto and selectively rotated by a drive mechanism (50). The support members are mounted to the door via greaseless and oil-free fulcrums (F). The fulcrums include a self-lubricating fulcrum insert (100) substantially surrounding a portion of the associated support member. The insert is made from a high-density polyethylene material. A filler (110) and a cover (126) are dimensioned to substantially surround or encapsulate the fulcrum insert. Mounting flanges on the fulcrum filler and fulcrum cover include openings for receiving fasteners to secure the fulcrum to one of the horizontal reinforcing channels of the railcar door.

21 Claims, 5 Drawing Sheets

GREASELESS FULCRUM FOR A RAILCAR DOOR

BACKGROUND OF THE INVENTION

The present invention relates generally to the art of railway cars. More particularly, the invention pertains to greaseless fulcrums for gear-operated railway car doors. The invention is particularly applicable to plug-type metal doors of the type used on railway freight cars and will be particularly described with reference thereto. However, it will be appreciated by those skilled in the art that the invention has broader applications and is adaptable to use with doors of other types and in other environments.

Rectangular metal doors of a known type used in railway cars include a generally rectangular frame typically comprised of top, bottom, horizontal stiffeners, and opposed side members. Metal panels are secured to these frame members for completing the basic door construction. In most conventional railway cars, the frame members and metal panels are riveted and/or welded together.

Railway car doors are typically classified as either sliding doors or plug doors. Of the two, sliding doors are less complex, having a door configured to slide back and forth within a side panel of a railway car to selectively open and close an opening defined therein. Plug doors are more complex in that they are configured to first move laterally out of the opening defined in the railway car and then move longitudinally along a track disposed adjacent the railcar side panel.

Plug doors to be mounted on the side of a railcar include a series of panels or sheeting reinforced by horizontally disposed channels at the top, bottom and/or intermediate portions of the door. A pair of vertically-oriented elongated support members such as pipes, rods or bars are configured to support the door on the railcar. The support members are typically provided with upper and lower cranks attached to the ends thereof which serve as lever arms for laterally moving the door into and out of the railcar door opening. Upon actuation of a driving mechanism, such as a manually operated gear assembly, the support members are rotated causing corresponding rotation of the cranks. Rotation of the cranks, in turn, draws the door laterally outward from the opening until the door is supported on a track disposed adjacent the side of the railcar. The door is moveably supported on the track by roller hangers which enable the door to slide longitudinally along the side of the railcar.

The support members are rotatably mounted to the door via a plurality of brackets or fulcrum assemblies disposed on the door along the length of the support members. The fulcrum assemblies generally include an outer shell or cover member surrounding a lubricant fitting for holding a lubricant. Grease is commonly used as the lubricant for providing substantially friction free rotation of the support members within the fulcrum assemblies. Although grease has long been used as a lubricant for the support members, it has several disadvantages.

One disadvantage resides in the fact that grease is difficult to maintain and seal and, thus, often leaks or escapes from its intended working environment. As a result, grease filled fulcrums must be continuously monitored to ensure that the grease has not escaped. A second disadvantage is that grease degrades over time, especially when exposed to harsh environments such as those experienced by railcars. As a result, the grease must be periodically replaced.

Conducting periodic maintenance is quite cumbersome and sporadic because there is no easy and convenient place for performing maintenance on railcars and no simple tracking method for determining when such maintenance should be undertaken. Typically, railcars remain in service for extended periods of time, thereby making it difficult to monitor and maintain the fulcrum assemblies. A third disadvantage is the fact that it is relatively expensive to maintain grease filled fulcrums, especially when the cost is calculated over the life of the railcar.

Accordingly, it has been considered desirable to develop a fulcrum assembly for plug-type railcar doors that addresses the foregoing difficulties and others while providing better and more advantageous overall results.

SUMMARY OF THE INVENTION

In accordance with the present invention, a greaseless fulcrum for a railcar door is provided. The railcar door includes a substantially planar wall. At least one elongated support member, such as a pipe or rod, has first and second terminal ends, and is rotatably mounted to the door. A drive mechanism for imparting a rotational force to the support member is operatively associated with the door. At least one greaseless and oil-free fulcrum is operatively connected to the support member for rotatably mounting the support member to the sheeting. The fulcrum includes a self-lubricating insert substantially surrounding a portion of the support member.

In accordance with a more specific aspect of the invention, the greaseless and oil-free insert is comprised of a self-lubricating material. The insert is dimensioned to substantially surround an axial portion or segment of the support member. The fulcrum further includes a filler which partially surrounds the insert and is dimensioned to be secured to the railcar door. A cover is provided which also partially surrounds the insert and is dimensioned to likewise be secured to the railcar door.

According to more limited aspects of the invention, the insert may comprise a one piece member having means cooperating with the filler and/or cover to prevent axial shifting therebetween, or may comprise single or multiple members secured to an associated door along with the filler and cover themselves.

In accordance with still another aspect of the invention, a method of rotatably mounting a support member to a railcar door via a greaseless and oil-free fulcrum is provided. The method includes the steps of substantially surrounding the support member with at least a portion of an insert made from a high-density polyethylene material, placing a portion of a filler in cooperating relation with a portion of the insert, positioning a portion of a cover in cooperating relation with a portion of the insert, and then securing the filler and cover to a railcar door.

A principal advantage of the present invention resides in the provision of a fulcrum assembly which operates effectively without the use of grease.

Another advantage of the invention is found in the provision of a fulcrum assembly that is relatively easy to maintain.

Another advantage of the invention resides in the provision of a fulcrum assembly that is relatively low in cost.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
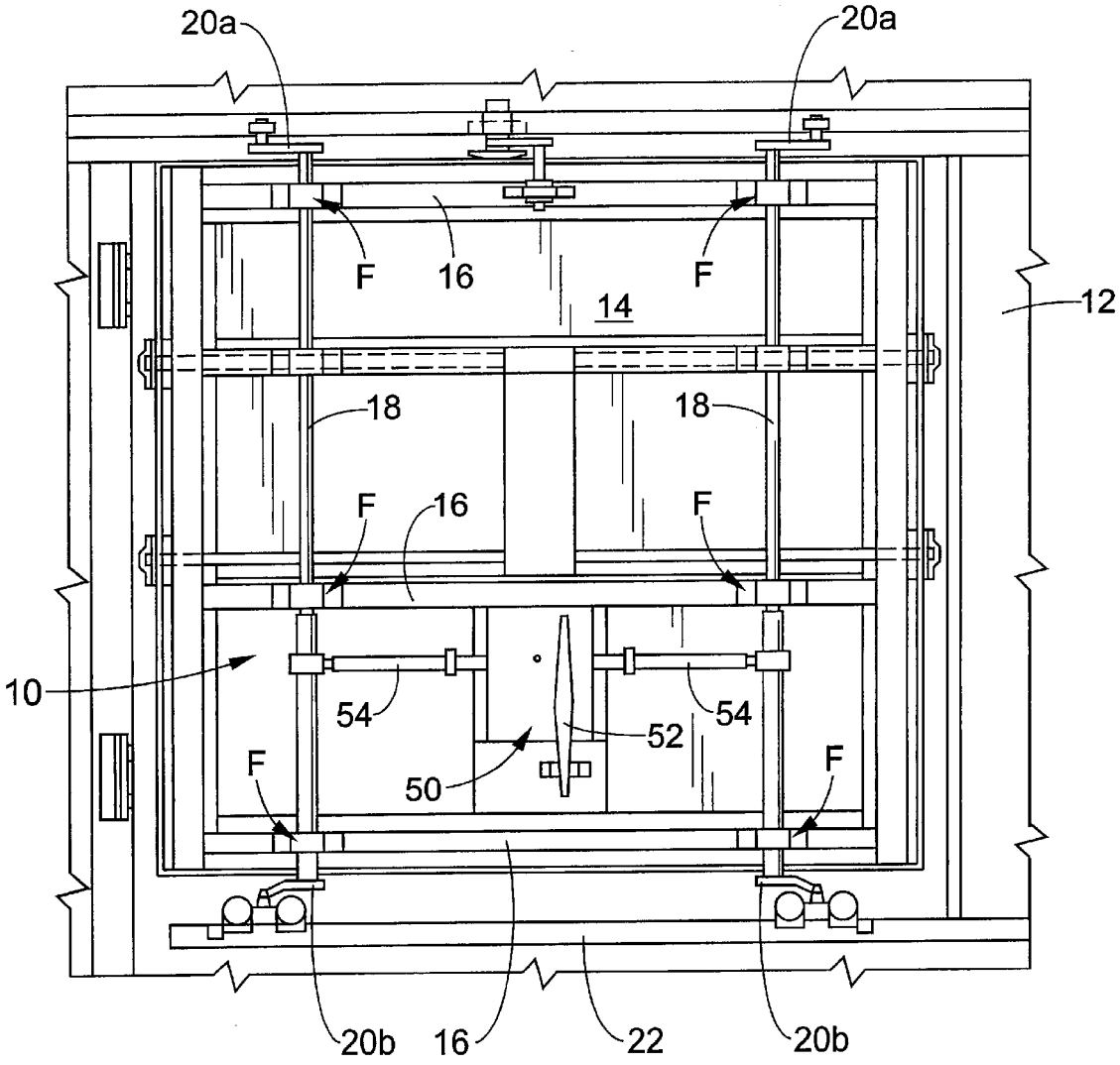
FIG. 1 is a front elevational view of a railcar door which includes fulcrums formed in accordance with a preferred embodiment of the present invention.

Referring now to the drawings wherein the showings are for purposes of illustrating preferred embodiments of the invention only and not for limiting same, FIG. 1 shows a plug-type railcar door 10 disposed in an opening 12 in a railcar in accordance with the preferred embodiment of the present invention. The door includes a wall of paneling 14 reinforced with horizontal channels 16 extending across top, bottom and intermediate portions of the sheeting. The paneling 14 is typically fabricated from metal sheeting.

The door 10 is supported by a pair of elongated support members 18, such as pipes, rods or tubes, which are disposed along the vertical height of the door. The support members are rotatably mounted to the horizontal reinforcing channels 16 at the outer surface of the door via brackets or fulcrums F located adjacent the side edges of the door for retaining the support members in a vertical disposition.

Each of the support members 18 includes a first or upper end having a first or upper crank 20*a* and a second or lower end having a second or lower crank 20*b* operatively connected thereto. The cranks 20*a*, 20*b* serve as lever arms which enable the door to move laterally into and out of the railcar opening 12. The door 10 is adapted to move laterally out of the door opening toward the outside of the railcar until the door is supported on a track 22 disposed adjacent the railcar side wall. The door is then moved longitudinally along the side of the car on track 22 to effectively expose the door opening to facilitate car loading and unloading. Thus, when it is in the unplugged position, the door is movably supported on the track 22 by roller hangers 24 which are attached to the ends of the lower cranks 20*b* for guiding the door during its longitudinal movement.

As is well understood in the art, rotation of the support members 18 will cause a corresponding outward rotation of the cranks 20*a*, 20*b* to sequentially draw the door 10 laterally outward from the door opening. An operating mechanism generally designated 50 is provided on the door for controlling the rotation of the support members 18 and the cranks in a manner well known in the art. An activating member in the form of a handle 52 is used to control the operating mechanism through a linkage and transmission arms 54.

Figure 2:
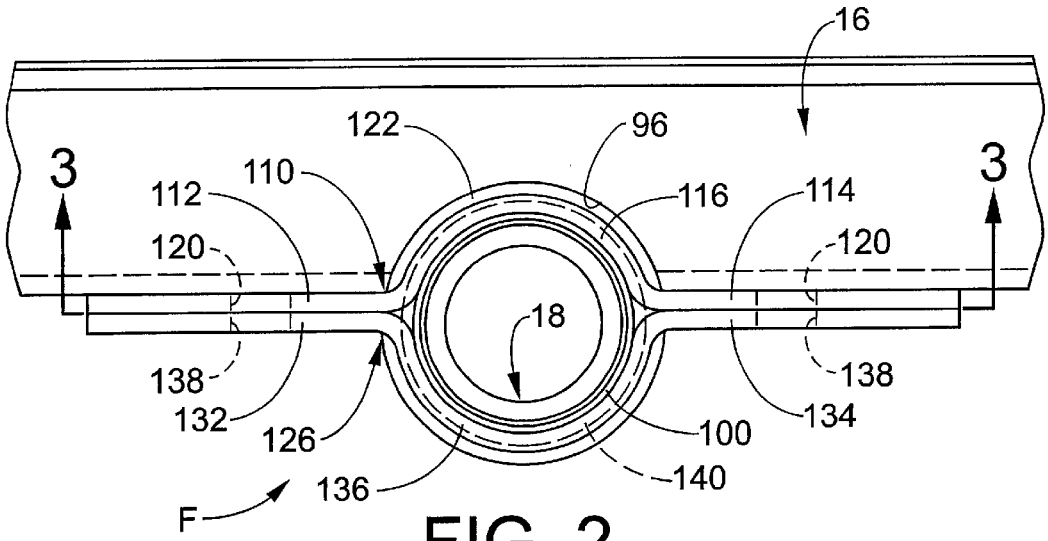
FIG. 2 is a side view of a fulcrum of the subject invention mounted to a horizontal reinforcing member of a plug-type door and viewed longitudinally of an associated support member.
Figure 3:
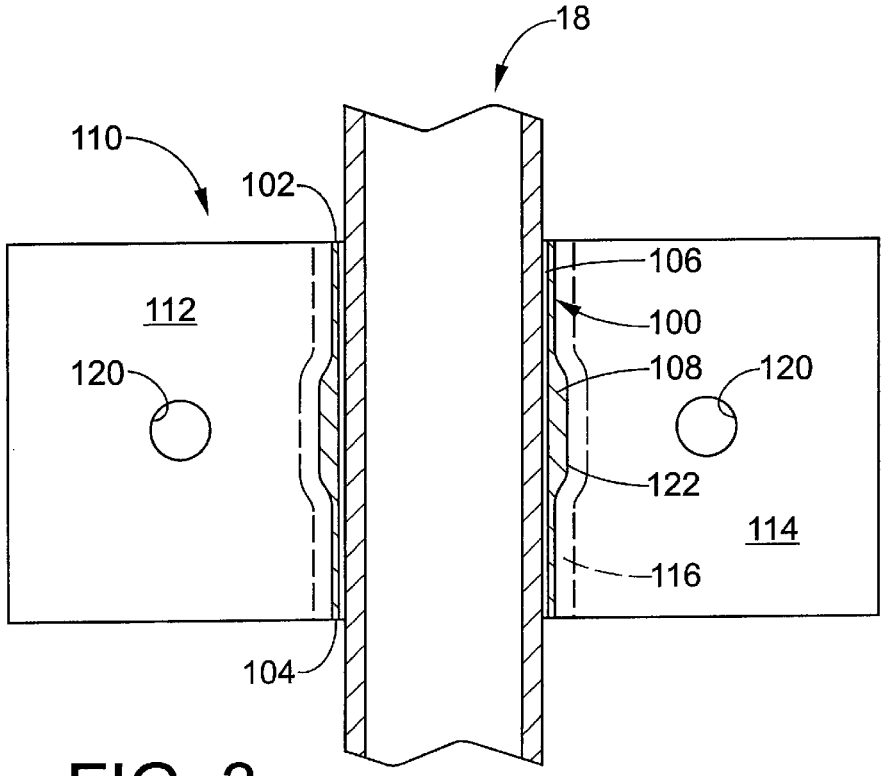
FIG. 3 is a cross-sectional view of the fulcrum taken longitudinally along lines 3—3 in FIG. 2.

FIGS. 2 and 3 show a greaseless and oil-free fulcrum F for receiving one of the support members 18 in accordance with a preferred embodiment of the present invention. In the door construction of FIG. 1, a plurality of the fulcrums are advantageously employed, it being appreciated that they are identical in construction unless otherwise specifically noted. In this embodiment, the fulcrum is configured to be secured to one of the horizontal reinforcing channels 16 of the railcar door. A semicircular recess 96 is provided in the horizontal channel itself for receiving at least a portion of the fulcrum.

The fulcrum includes an insert 100 configured and dimensioned to peripherally surround an axial segment of the support member. The insert is preferably cylindrical in cross-section having opposed first and second ends 102, 104 and a through passage 106. The fulcrum insert is preferably made from a high-density polyethylene material (HDPE) which is suitable for replacing the grease found in conventional fulcrums for railcar doors. The polyethylene material provides a low friction surface which enables the support member 18 to rotate freely. Preferably, the HDPE has a molecular weight in the range of 200,000 to 500,000. The HDPE advantageously provides a self-lubricating surface which acts as an effective substitute for grease. Although polyethylene is the preferred material, it should be appreciated that other materials suitable for replacing grease may also be used for the fulcrum insert.

With particular reference to FIG. 3, the fulcrum insert includes a raised bulbous annular portion 108 extending peripherally around the exterior thereof intermediate ends 102, 104. The raised portion effectively retains the insert from undesired axial shifting relative to the remainder of the fulcrum in a manner as will become apparent. In a typical railcar door application, the non-raised portion of the fulcrum insert has an outside diameter of approximately 5.4 centimeters (2⅛ inches), while the outside diameter of the raised portion is approximately 6.032 centimeters (2⅜ inches). The inside diameter of the insert is approximately 5.08 centimeters (2.00 inches). Of course, other suitable dimensions may be used as well to accommodate specific door constructions.

With continued reference to FIGS. 2 and 3, the fulcrum includes a filler 110 preferably made from a commercially available mild steel and configured to at least partially surround the fulcrum insert. The filler may be made from other suitable materials as well. The filler includes first and second planar portions or flanges 112, 114 interconnected by a semi-cylindrical portion 116. The semi-cylindrical portion 116 is dimensioned to be seated in the cooperating recess 96 of the associated reinforcing channel 16 and surrounds some portion of the insert.

The planar or flange portions 112, 114 are configured to be secured in face-to-face relation with an outer surface of the horizontal channel 16. To that end, the filler is provided with an opening 120 through each of planar flange portions 112, 114 for receiving mechanical fasteners for securely mounting the fulcrum filler to channel 16. As shown in FIGS. 2 and 3, the semi-cylindrical portion 116 of the filler 110 substantially conforms to the shape of the insert. Thus, a recessed area 122 is defined in the semi-cylindrical portion of the filler for accommodating the raised portion 108 of the insert (FIG. 3) and thereby maintain the axial position of the insert within the fulcrum.

The fulcrum further includes a cover 126 configured and dimensioned to surround the portion of the insert not surrounded by the filler 110. The filler and cover provide a protective shell for the insert which protects it from the harsh environment encountered by railcar doors. In the illustrated embodiment, the filler surrounds approximately one half of the insert, while the cover surrounds the other half.

The cover 126 essentially comprises a mirror image of the filler including first and second planar portions or flanges 132, 134 interconnected by a semi-cylindrical portion 136. The planar or flange portions are configured to register with flanges 112, 114, respectively, of the filler. Openings 138 are provided through the flanges to register with openings 120 and receive fasteners (not shown) to secure the cover and filler to channel 16. The semi-cylindrical portion 136 of the cover conforms to the shape of the insert to thus includes a recessed area 140 for embracing the raised portion of the fulcrum insert. Such relationship, again, assists in prohibiting axial shifting of the insert during fulcrum use.

The fulcrum effectively eliminates the need for grease as a lubricant for the rotatable support members 18. The use of a fulcrum insert made from a self-lubricating material, such as HDPE or other suitable material, enables the support members of railway doors to rotate freely without the use of grease. Thus, the difficulties previously associated with sealing, maintaining, and monitoring grease filled fulcrums are effectively eliminated. In the preferred form of the subject invention, the fulcrum is dimensioned to support approximately 3 to 4 inches of the length of the associated support member 18. As such, a plurality of fulcrums are employed for each support member (FIG. 1).

Figure 4:
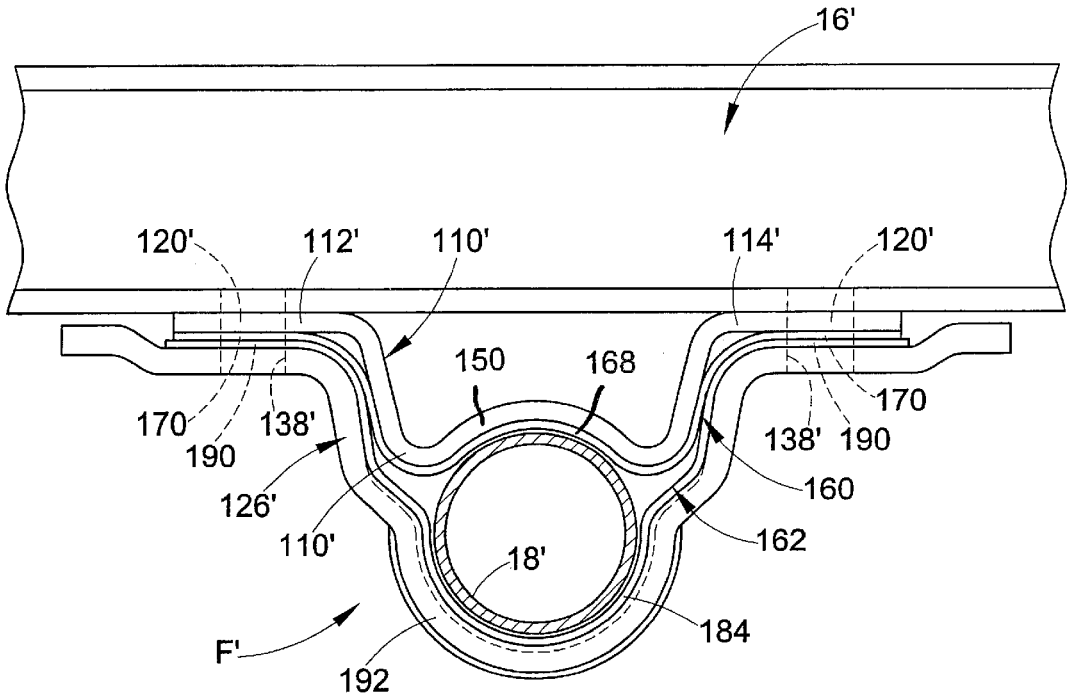
FIG. 4 is a view similar to FIG. 2 showing a second embodiment of the invention.

Several alternative arrangements for providing a greaseless fulcrum for the support members are also contemplated by the present invention. With reference to FIG. 4, for example, the fulcrum is shown in accordance with a second preferred embodiment of the invention. With regard to this second embodiment, and for ease of appreciating the structure thereof, like numerals with a primed (') suffix identify like components and new numerals identify new components.

Figure 5:
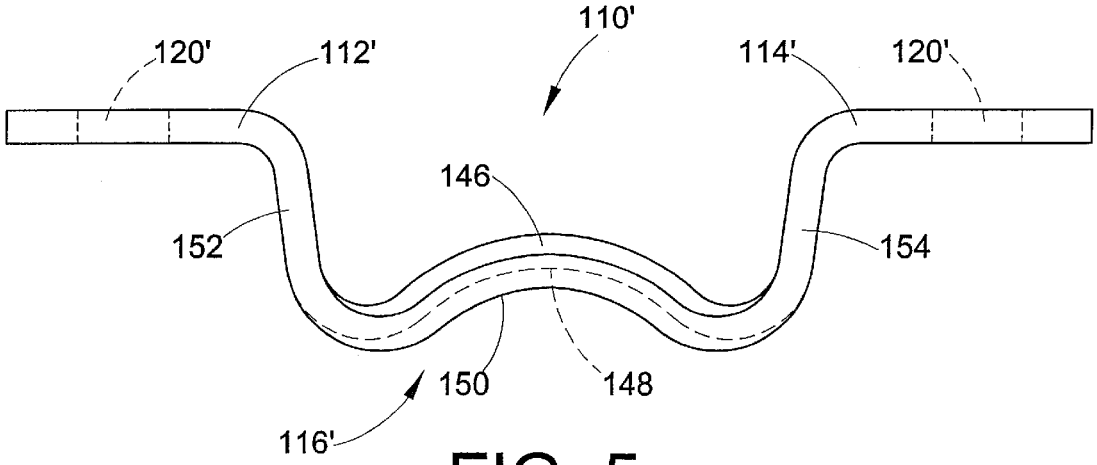
FIG. 5 is a side view of the fulcrum filler used in the structure of FIG. 4.

With continued general reference to FIG. 4 and particular reference to FIG. 5, the fulcrum F' includes a filler 110' configured to be mounted to a surface of the horizontal reinforcing channel 16'. The filler includes a pair of flanges 112', 114' interconnected by a central portion 116'. The flanges are configured to be mounted to a surface of the horizontal reinforcing member 16' through openings 120'.

The filler is formed to include a raised external boss 146 and a corresponding internal recess area 148 which extend laterally across a segment of central portion 116' to strengthen the filler. It would also be possible to use recess 148 to receive a protrusion on an associated insert to maintain axial positioning. The central portion 116' of the filler includes a semicircular area 150 and leg portions 152, 154 extending to flanges 112', 114', respectively. Semi-cylindrical area 150 is concave relative to the plane of flanges 112', 114' and defines a receiving channel or trough for a peripheral segment of a support member in a manner to be further described.

Figure 6:
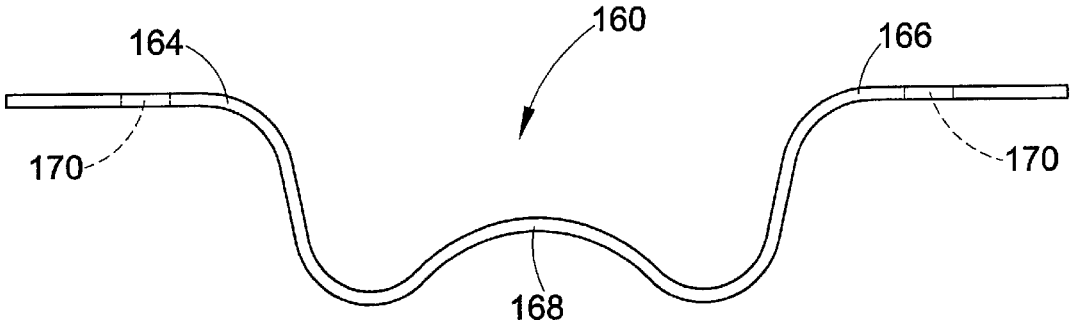
FIG. 6 is a side view of the fulcrum filler insert used in the structure of FIG. 4.
Figure 7:
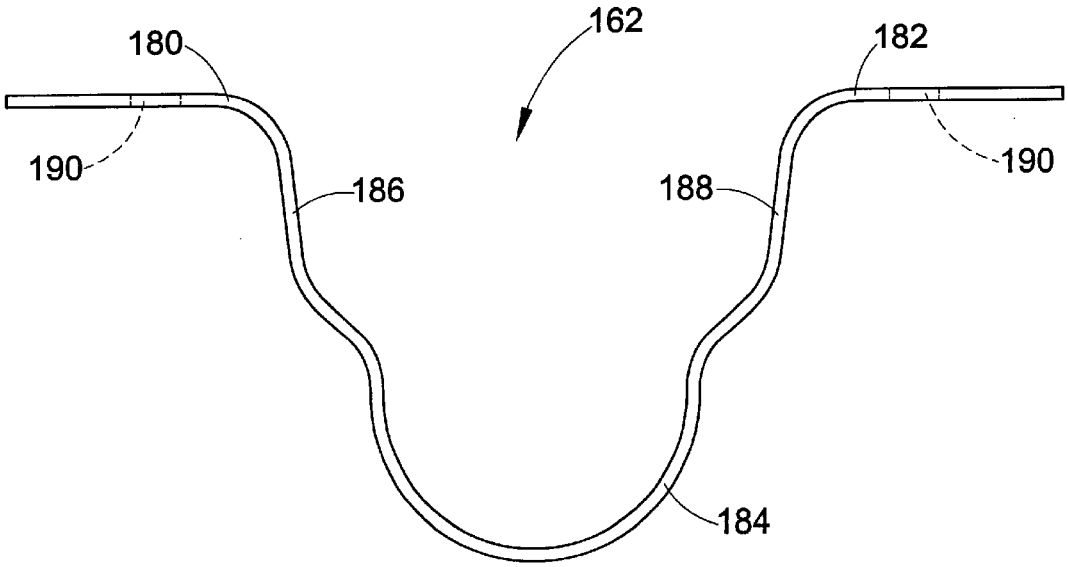
FIG. 7 is a side view of the fulcrum cover insert used in the structure of FIG. 4.

With reference also to FIGS. 6 and 7, a two piece fulcrum insert for the embodiment of FIG. 4 is shown as comprising a filler insert 160 and a fulcrum cover insert 162. The filler insert has generally the same shape as the filler 110' and is configured to embrace a segment of the support member 18' internally of the fulcrum. Like the filler, the insert includes first and second legs or flanges 164, 166 interconnected by a generally semi-cylindrical portion 168. The semi-cylindrical portion is dimensioned to partially surround a portion of the associated elongated support member. The legs or flanges 164, 166 are configured to have portions that lie flush against the planar portions or flanges 112', 114', respectively of the fulcrum filler 110' (FIG. 4). Each of the legs or flanges includes elongated mounting slots or openings 170 adapted for registry with openings 120' in the filler 110'. The filler insert is made from a high-density polyethylene material (HDPE) which is suitable for replacing the grease used in conventional fulcrums for railway cars, although other suitable materials may also be used.

Referring to FIG. 7, the fulcrum cover insert 162 has first and second planar legs or flanges 180, 182 interconnected by a generally semi-cylindrical portion 184. The fulcrum cover insert is also preferably made from a high-density polyethylene material although, again, other suitable materials may be used to satisfaction. The semi-cylindrical portion 184 is dimensioned and configured to at least partially embrace an associated elongated support member and has a slightly greater arcuate extent or span than the semi-cylindrical portion 168 of the fulcrum filler insert 160 (FIG. 6). The legs or flanges 180, 182 include first portions 186, 188, respectively, configured to lie generally flush against a portion of legs 164, 166 of the insert 160 (FIG. 4). The legs further include terminal end portions having openings or slots 190 for registry with slots 170 of filler insert 160 and openings 120' in filler 110' for mounting or securing purposes.

Figure 8:
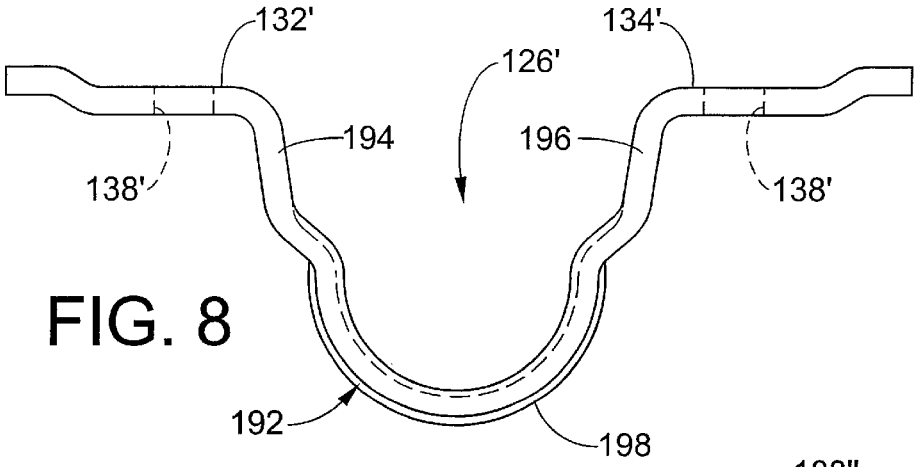
FIG. 8 is a side view of the fulcrum cover used in the structure of FIG. 4.

FIG. 8 shows a fulcrum cover 126' having substantially the same shape and conformation as the cover insert 162 and dimensioned to fit over the cover insert in the manner shown in FIG. 4. The cover is preferably formed from a commercially available mild steel. Like the insert, the cover includes first and second legs 132', 134' interconnected by a semi-cylindrical portion 192. Each of the legs includes a planar terminal end or flange configured to lie flush against similar planar portions at the terminal ends of legs 180, 182 of the cover insert. First portions 194, 196 of the fulcrum cover legs extend to and merge with semi-cylindrical portion 192 and generally conform to legs 184, 186 of cover insert 162 (FIG. 4). The semi-cylindrical portion 192 also includes an embossed area 196 in a substantially mirror image to boss 146 on filler 110' and a similar recessed area 198 for strengthening and for possible cover positioning purposes.

Openings 138' extend through the terminal end portions of the legs 132', 134' for registry with the openings or slots in members 110', 160 and 162 for receiving fasteners (not shown) to securely affix the fulcrum device to the associated horizontal member 16'. Such arrangement allows free rotation of an elongated support member captured by insert portions 160, 162 of the fulcrum to be freely rotated about its longitudinal axis without the need for using grease or other lubricants.

Figure 10:
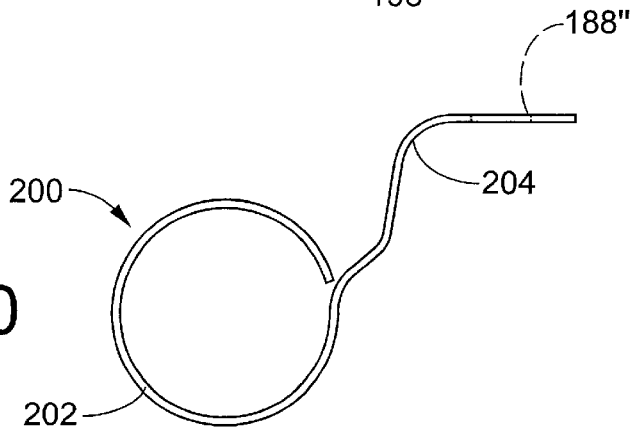
Figure 9:
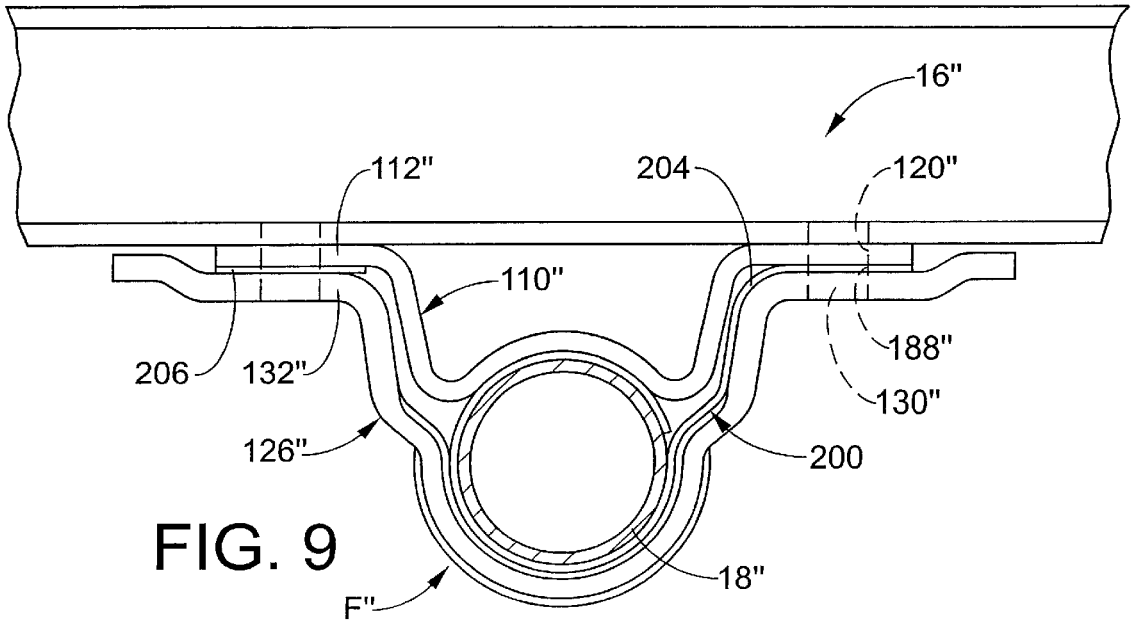
FIG. 9 is an end view similar to FIG. 4 showing another alternative form of the invention; and, FIG. 10 is an end view of a one-piece insert used in the embodiment of FIG. 9.

Referring now to FIGS. 9 and 10, an alternate embodiment of the fulcrum is illustrated wherein like numerals with a double primed (") suffix identify like components and new numerals identify new components. The fulcrum of this embodiment is substantially identical to that shown in FIG. 4, except that it includes a one-piece insert 200 in place of the two-piece insert as represented by elements 160, 162 in FIG. 4. The one-piece fulcrum insert includes a substantially cylindrical portion 202 having a single leg 204 extending generally radially therefrom. Leg 204 is substantially identical, including mounting opening 188", to the leg 182 of the fulcrum cover insert shown in FIG. 7. A filler member 206 (FIG. 9) is advantageously provided between legs 112", 132" of the filler 110" and the cover 126", respectively opposite the location of leg 204.

The invention has been described with reference to the preferred embodiments. Obviously, modifications and alterations will occur to others upon a reading and understanding of this specification. The invention is intended to include all such modifications and alterations insofar as they come within the broad meaning and scope of the appended claims or the equivalents thereof.

Having thus described the preferred embodiments, the invention is now claimed to be:

1. A railcar door comprising:

a substantially planar door;

at least one elongated support member rotatably mounted to said door;

a drive mechanism operatively connected to said support member for selectively rotating said support member about its length;

at least one fulcrum cooperatively associated with an axial segment of said support member and allowing relative rotation between said fulcrum and support member; and, said fulcrum having a body portion including a filler and a cover which cooperate to capture a self-lubricating insert disposed in substantially surrounding relation to an axial segment of said support member, wherein said filler is comprised of opposed planar end portions interconnected by a central portion having a semi-cylindrical conformation over at least a portion thereof.

2. The A railcar door comprising:

a substantially planar door;

at least one elongated support member rotatably mounted to said door;

a drive mechanism operatively connected to said support member for selectively rotating said support member about its length;

at least one fulcrum cooperatively associated with an axial segment of said support member and allowing relative rotation between said fulcrum and support member; and, said fulcrum having a body portion including a filler and a cover which cooperate to capture a self-lubricating insert disposed in substantially surrounding relation to an axial segment of said support member, wherein said filler and cover each includes opposed planar portions interconnected by a central portion having a semi-cylindrical conformation over at least a portion thereof, terminal end portions of said filler and cover planar portions being disposed in registry with each and secured to said door, said cylindrical portions substantially surrounding said insert.

3. The railcar door according to claim 2 wherein said insert includes a passage extending longitudinally therethrough in embracing relation to said support member, and said insert further includes a bulbous area extending peripherally around at least a portion of the exterior surface thereof.

4. The railcar door according to claim 3 wherein said semi-cylindrical portions of at least one of said filler and cover includes a recessed area for closely receiving at least a portion of said insert bulbous area to prevent relative shifting between said insert and said filler and cover axially of said support member.

5. The railcar door according to claim 4 wherein said insert is comprised of a high-density polyethylene material.

6. The railcar door according to claim 2 wherein said insert is comprised of a filler insert portion and a cover insert portion disposed in surrounding relation to said support member.

7. The railcar door according to claim 6 wherein said filler insert and said cover insert each includes a semi-cylindrical portion surrounding a portion of the elongated support member and closely embraced by said filler and cover, respectively.

8. The railcar door according to claim 7 wherein said filler insert and cover insert portions each further includes planar portions, the terminal ends of said filler insert and cover insert planar portions being interposed between and in registry with the planar portions of said filler and insert.

9. The railcar door according to claim 8 wherein said filler insert and said cover insert are each comprised of high-density polyethylene material.

10. The railcar door according to claim 2 wherein said insert has a body portion disposed in surrounding relation with an axial segment of said support member and a leg portion extending generally radially outward from said body portion, said leg portion being interposed between and in registry with cooperating planar portions of said filler and cover.

11. A fulcrum for rotatably mounting an elongated support member to a railcar door comprising:

a filler having opposed planar portions interconnected by a central portion having a semi-cylindrical conformation over at least a portion thereof, said opposed planar portions of said filler each having terminal ends;

a cover having opposed planar portions interconnected by a central portion having a semi-cylindrical conformation over at least a portion thereof, said opposed planar portions of said cover each having terminal ends;

said terminal ends of said filler and cover planar portions adapted to be placed in registry with each other for securing to an associated railcar door and with said filler and cover semi-cylindrical portions defining an insert receiving cavity; and, an insert comprised of a self-lubricating material adapted for placement in close surrounding relation to an elongated support member on an associated railcar door, said insert being retainingly interposed between said filler and cover.

12. The fulcrum according to claim 11 wherein said insert includes means for placing the insert, filler and cover in a secured relationship to prevent movement therebetween axially of an associated support member.

13. The fulcrum according to claim 12 wherein said insert is comprised of a filler insert portion and a cover insert portion each of which includes a semi-cylindrical portion closely encircling a peripheral portion of an associated support member over an axial segment thereof.

14. The fulcrum according to claim 13 wherein each of said filler insert and cover insert portions includes terminal ends and planar portions extending from the semi-cylindrical portions and interposed between in registration with said terminal ends of said filler and cover planar portions for attachment to an associated railcar door.

15. The fulcrum according to claim 13 wherein said filler insert and cover insert are comprised of a self-lubricating high-density polyethylene material.

16. The fulcrum according to claim 12 wherein said insert includes a body portion for substantially embracing the periphery of an associated support member over an axial segment thereof and a leg portion extending generally radially outward from said body portion, said leg portion being interposed between and in registry with one set of cooperating planar portions of said filler and cover.

17. The fulcrum according to claim 16 further including a spacer interposed between and in registry with the other set of cooperating planar portions of said filler and cover.

18. The fulcrum according to claim 16 wherein said insert is comprised of a self-lubricating high-density polyethylene material.

19. The fulcrum according to claim 11 wherein said insert includes a bulbous area extending peripherally thereof and the semi-cylindrical portion of at least one of said filler and cover includes a recess closely embracing at least a portion of said bulbous area.

20. The fulcrum according to claim 19 wherein said bulbous area extends around the entirety of said insert and the semi-cylindrical portions of both of said filler and cover include said recess.

21. The fulcrum according to claim 19 wherein said insert is comprised of a self-lubricating high-density polyethylene material.

* * * * *